United States Patent [19]

Bergerud

[11] 4,234,979

[45] Nov. 25, 1980

[54] FOLDING BED-FRAME MEMBER AND BED ASSEMBLY

[76] Inventor: Wilson L. Bergerud, 30 Herring St., Harrington Park, N.J. 07640

[21] Appl. No.: 801

[22] Filed: Jan. 4, 1979

[51] Int. Cl.[2] ..... A47K 19/06

[52] U.S. Cl. ..... 5/133; 5/164 R

[58] Field of Search ..... 5/10, 133–137, 5/149, 156, 157, 164 R, 176 R, 184, 200 R

[56] References Cited

U.S. PATENT DOCUMENTS

| | | | |
|---|---|---|---|
| 1,898,578 | 2/1933 | Fox | 5/156 |
| 3,116,494 | 1/1964 | Bennett et al. | 5/164 R |
| 3,179,956 | 4/1965 | Bennett | 5/164 R |
| 3,784,991 | 1/1974 | Watson et al. | 5/136 |
| 4,135,266 | 1/1979 | Knoke | 5/181 |

*Primary Examiner*—Casmir A. Nunberg

*Attorney, Agent, or Firm*—Richard P. Fennelly

[57] ABSTRACT

A spring-balanced, wall-type bed-frame member, which is adapted to support a portion of a mattress assembly, is pivotable between a vertical position adjacent a wall and a horizontal position upon a floor for use. A plurality of the frame members are needed to support the mattress assembly for a bed. The bed contains no permanent cross members linking the respective bed-frame members, so that the location of the frame members can be laterally changed to accommodate mattress assemblies of differing widths.

9 Claims, 6 Drawing Figures

FOLDING BED-FRAME MEMBER AND BED ASSEMBLY

BACKGROUND OF THE INVENTION

1. Field of the Invention

The present invention relates to a spring-balanced wall-type bed-frame member and to a bed assembly containing a plurality of said bed frame members.

2. Description of the Prior Art

Spring-balanced wall-type bed assemblies, which contain: (1) a mattress assembly (e.g., mattress and either springs or boxspring); and (2) a bed-frame, are known. One recent example is shown in U.S. Pat. No. 4,050,106 to L. Wolfe. In such devices, however, the bed-frame is an integral unit comprising two side members which are permanently joined together by at least one cross member. The width of the frame is approximately equal to the width of the mattress assembly it is intended to hold, so that the side members support the two opposed edge portions of the mattress assembly. Such bed assemblies are, therefore, designed to hold only one type of mattress assembly (for example, for either a double, queen-size, or king-size bed) and cannot be used with mattress assemblies having a differing width. The only option that a person would have in order to fit a number of mattress assemblies of differing widths would be to purchase a plurality of such integral bed-frames, each having a width which corresponds to the width of the particular mattress assembly for which it is intended.

SUMMARY OF THE PRESENT INVENTION

The present invention relates to a spring-balanced, wall-type bed-frame member, which is adapted to support only a portion of a mattress assembly, and which is pivotable between a vertical position adjacent a wall and a horizontal position upon a floor for use. The frame member comprises two side bars which are joined together by a plurality of cross members. The length of the cross members, and, consequently, the width of the frame member, is substantially less than the width of the mattress assembly that the frame member is intended to support so that a plurality of said frame members are required to support a particular mattress assembly.

DESCRIPTION OF THE DRAWINGS

The present invention may be further understood by reference to the Drawings which form a portion of this specification wherein.

DETAILED DESCRIPTION OF PREFERRED EMBODIMENTS OF THE INVENTION

Figure 1:
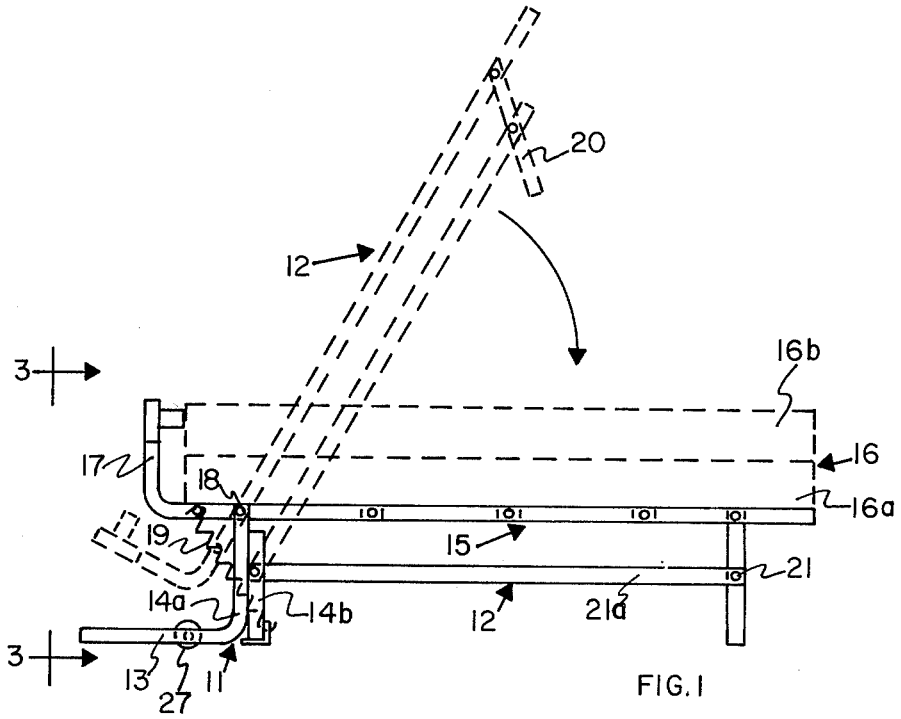
FIG. 1 is a side view of a bed assembly containing the pivotable frame member of the present invention as it is being rotated downwardly (shown in phantom outline) from its stored position against a wall to its fully deployed position on a floor (shown in solid outline)
Figure 2:
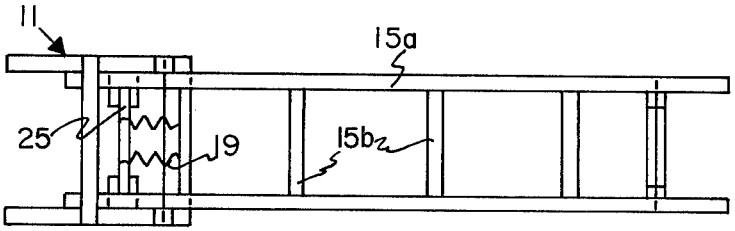
FIG. 2 is a view from above showing one of the frame members of the present invention in its fully deployed configuration.
Figure 3:
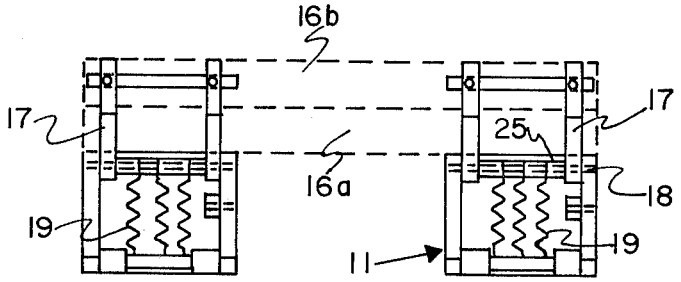
FIG. 3 is a view of the bed assembly of FIG. 1 from the direction shown by arrows 3–3' in FIG. 1.

FIGS. 1 and 2 show the frame member of the present invention from the top when fully deployed (FIG. 2) and from the side when in a partially deployed and in a fully deployed configuration (FIG. 1), respectively.

The frame member of the present invention comprises a base 11 which is adapted to be securely fixed to the floor of a room by suitable fastening means and a support section 12 which is pivotally mounted on a portion of the base 11 so as to be pivotable between a vertical position adjacent a wall of a room and a horizontal position upon the floor of the room.

The base 11 is preferably generally L-shaped and comprises one section 13 which rests upon the floor and another section 14 which is perpendicular to the floor and which can be formed of either a single member, or, as shown in FIG. 1, by two joined members **14*a* and 14*b***.

Pivotally attached to a portion **14*a* of the base 11 is support section 12 which comprises a relatively long mattress support section 15 against which the bottom of mattress assembly 16 (which preferably comprises boxspring 16*a* and mattress 16*b*) is placed. The mattress support section 15 is appropriately dimensioned in length so that it provides adequate support for mattress assembly 16**. It is generally of the same length as the mattress assembly or slightly longer.

The generally planar support section 15 preferably merges at one end thereof, adjacent the base 11 with a short, planar support member 17 which is generally perpendicular to the support section 15 and which provides a resting place for the mattress assembly 16 when the L-shaped support section 12 is pivoted to its vertical position. The bottom of the mattress assembly 16 can be secured to the support section 15 by any means known to persons of ordinary skill in the art, e.g., straps, latches, screws, bolts, etc. In FIG. 2, a plurality of cross members **15*b* link the two side members 15*a* of support 15 and have a length which is substantially less than the width of the mattress assembly 16 which the support is intended to support. Since the width of the support section 15 is substantially less than the mattress assembly width, two or more supports 15** are needed to support a given mattress assembly.

The support section 12 is preferably formed of hollow steel tubing so as to provide a construction which is both light and durable. This material gives a support section which is easily pivotable about pivot 18 on base portion **14*a*** because of its relatively low weight.

As shown in FIG. 1, an anti-shock bumper 27 can be attached to a portion of base section 13 to cushion the movement of support section 17 as it nears base section 13. It can comprise a generally cylinderical rubber material surrounding a suitably dimensioned rod which is attached at either of its respective ends to a portion of base section 13.

In order to provide for the secure footing on the floor of that portion of the support section 15 which will form the foot of the bed, a pivotable leg 20 is provided adjacent that end of the support section. As best shown in FIG. 1, the leg 20 is pivotally connected at one of its ends to the support section 15 and has a second pivotal connection 21, interior of the end connected to the support section 15, which is linked to a portion of base 11 at a location below pivot 18 on the base 11 by means of a planar linkage member **21*a*. When the support 12 is pivoted downwardly from its vertical, stored position, the linkage member 21***a* causes pivotal rotation of the leg 20 until it reaches a substantially perpendicular position with relation to the plane of support section 15 and thereby provides a support for the foot of the bed in its fully deployed position as depicted in FIG. 1.

Figure 4:
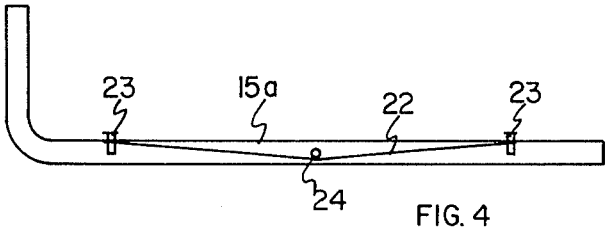
FIG. 4 is a crossectional side view of one of the side members of the frame member shown in FIG. 2.
Figure 5:
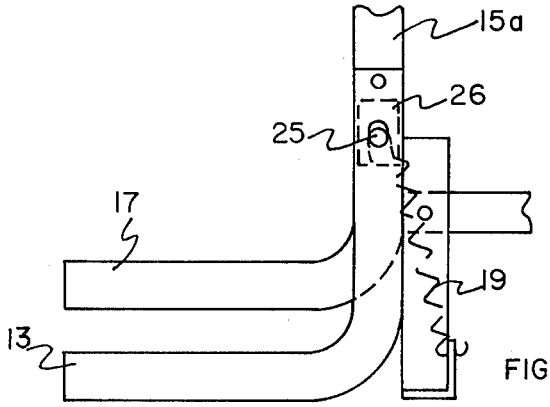
FIG. 5 is an enlarged side view of the pivotal frame member of the present invention when it is in its vertical, stored configuration.

FIG. 4 illustrates a particularly preferred way in which the tubular members 15*a* of support 12 can be reinforced so as to be capable of supporting a greater amount of weight than normal without deformation of the tubing. Such an embodiment allows the use of lighter weight tubing and is preferred from a weight reduction viewpoint. The Figure shows that the tubing forming support side member 15*a* has attached to it on one side thereof, by suitable fastening means 23, the two portions of a metal strap (e.g., a 26 gauge, $\frac{3}{4}$ inch metal strap) which is under tension by virtue of its secure attachment at said portions and its being brought to bear against the opposed side of the tubular member by member 24, which can be the same type of means as fastening means 23. These reinforced tubular members form another aspect of the present invention.

Figure 6:
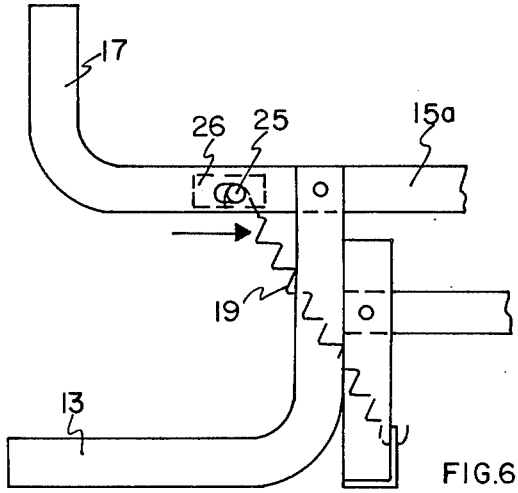
FIG. 6 is a view similar to that shown in FIG. 5 when the frame is in its fully deployed configuration.

In a preferred embodiment of the present invention (as best shown in FIG. Nos. 5 and 6), the upper ends of the spring means 19 are attached to a generally round shaft 25 which is inserted into a hole (e.g., a $\frac{3}{8}$ inch hole) in a rectangular carrier 26 inside the tubular side member 15*a*. The shaft passes through a slightly larger hole (e.g., a $\frac{5}{8}$ inch hole) formed in the surface of the member 15*a*. When the support member 15*a* is rotated downwardly and reaches a certain position (e.g., a 30 degree angle to the horizontal), the tension action of the spring means 19 causes the shaft 25 to shift (as shown by the arrow in FIG. 6) against the edge of the larger hole formed in support member 15*a* providing a certain degree of locking action which allows the bed frame to be moved gently to the floor and be locked in that position. Some slight degree of force is needed to lift the support 15*a* back past the position at which this shifting occurs and allow full compressive action of the spring means 19 to come into play. This causes the shaft 25 to shift back to its original position and allows for easy raising of the frame member to its stored, vertical configuration.

A number of modifications can be made to the present invention without departing from its spirit and scope. For example, metal strap 22 can be replaced with other forms of reinforcing members, such as metal wires, cables, etc. Also, an extra degree of support can be provided between the respective support section 12 in a given bed assembly at a position forward of the base by only semi-permanently joining the support sections together with detachable support members, e.g., telescoping rods, and the like. This type of optional support is not the type intended as "permanent" as that term is used herein.

The foregoing is merely illustrative of the present invention and should not be construed in a limiting sense. The scope of protection that is sought is set forth in the claims which follow.

What is claimed:

1. A frame member for a spring-balanced wall-type bed which is adapted to be pivotable between a vertical position adjacent a wall and a horizontal position upon a floor, said frame member comprising:

(a) a base which is adapted to be fixed to the floor; and (b) a support section pivotally mounted on the base and also attached at one portion thereof to said base by spring means, said support section being adapted to support a portion of a mattress assembly and having a width that is substantially less than the width of the mattress assembly such that a plurality of the frame members are needed to support the mattress assembly.

2. A frame member as claimed in claim 1 wherein the support section comprises two substantially parallel side members which are connected by a plurality of support members.

3. A frame member as claimed in either claim 1 or 2 wherein the support section also comprises pivotal leg means at one end thereof which is remote from the point of pivotal mounting of the support section to the base.

4. A frame member as claimed in claim 3 wherein a linkage member connects a portion of the leg means to a portion of the base so as to be capable of causing pivotal movement of said leg means.

5. A frame member as claimed in either claim 1 or 2 wherein at least some of the support section comprises tubular metal members.

6. A frame member as claimed in either claim 1 or 2 wherein the spring means are attached to a shaft member which is mounted for shiftable movement in the support section.

7. A frame member as claimed in claim 5 wherein at least one of the tubular metal members is reinforced by a metal member fixed at two of its portions on one side of the tubular member and is brought to bear against the opposed side of the tubular metal member.

8. A reinforced tubular metal member which is adapted to be used in forming the frame member of claim 1 which contains, as a reinforcing member, a metal strap fixed at two of its portions on one side of the tubular member and is brought to bear against the opposed side of the tubular member so as to provide reinforcement for the member.

9. A frame member as claimed in claim 1 wherein a portion of the base comprises bumper means for a portion of the pivotally mounted support section.

* * * * *